US011139109B2

(12) United States Patent
Henriksen et al.

(10) Patent No.: US 11,139,109 B2
(45) Date of Patent: Oct. 5, 2021

(54) LEAKAGE REACTANCE PLATE FOR POWER TRANSFORMER

(71) Applicant: ABB Power Grids Switzerland AG, Baden (CH)

(72) Inventors: Matthew Lee Henriksen, Raleigh, NC (US); Parag Upadhyay, Morrisville, NC (US)

(73) Assignee: ABB Power Grids Switzerland AG, Baden (CH)

( * ) Notice: Subject to any disclaimer, the term of this patent is extended or adjusted under 35 U.S.C. 154(b) by 191 days.

(21) Appl. No.: 16/125,138

(22) Filed: Sep. 7, 2018

(65) Prior Publication Data

US 2020/0082976 A1 Mar. 12, 2020

(51) Int. Cl.

| | |
|---|---|
| ***H01F 27/32*** | (2006.01) |
| ***H01F 27/34*** | (2006.01) |
| ***H01F 27/28*** | (2006.01) |
| ***H01F 27/42*** | (2006.01) |

(52) U.S. Cl.

CPC ..... *H01F 27/346* (2013.01); *H01F 27/2828* (2013.01); *H01F 27/42* (2013.01)

(58) Field of Classification Search

USPC ..... 336/5, 160, 205–207

See application file for complete search history.

(56) References Cited

U.S. PATENT DOCUMENTS

| | | | | |
|---|---|---|---|---|
| 3,440,587 | A * | 4/1969 | Bartos | B26B 19/38 336/206 |
| 3,447,112 | A | 5/1969 | Broverman et al. | |
| 3,716,719 | A | 2/1973 | Angelery et al. | |
| 4,173,747 | A * | 11/1979 | Grimes | H01F 27/322 336/206 |
| 4,327,348 | A | 4/1982 | Hirayama | |
| 4,363,012 | A * | 12/1982 | Daikoku | H01F 27/322 336/185 |
| 5,621,372 | A | 4/1997 | Purohit | |
| 5,789,907 | A | 8/1998 | Casagrande | |
| 6,175,294 | B1 | 1/2001 | Hörnfeldt | |

(Continued)

FOREIGN PATENT DOCUMENTS

| | | |
|---|---|---|
| EP | 0355298 A2 | 2/1990 |
| EP | 2463870 A1 | 6/2012 |

(Continued)

OTHER PUBLICATIONS

Gokturk et al. "Electric and Magnetic Properties of a Thermoplastic Elastomer Incorporated with Ferromagnetic Powders" IEEE Transactions on Magnetics, dated Nov. 1993, pp. 4170-4176, vol. 29, No. 6.*

(Continued)

*Primary Examiner* — Mang Tin Bik Lian

(74) *Attorney, Agent, or Firm* — Sage Patent Group

(57) ABSTRACT

Unique systems, methods, techniques and apparatuses of a power transformer are disclosed. One exemplary embodiment is a transformer comprising a core; a first winding wound around the core; a second winding coaxially wound around the first winding so as to surround the first winding and forming an air gap between the first winding and second (Continued)

winding; and a plate having a relative permeability greater than 1 and less than 25 structured to be inserted into the air gap.

20 Claims, 4 Drawing Sheets

(56) References Cited

U.S. PATENT DOCUMENTS

| | | | | |
|---|---|---|---|---|
| 6,368,530 | B1 * | 4/2002 | Adubato | F28D 7/024 264/154 |
| 7,023,312 | B1 * | 4/2006 | Lanoue | H01F 27/085 336/60 |
| 7,788,794 | B2 * | 9/2010 | Sarver | H01F 41/063 29/602.1 |
| 9,734,943 | B2 * | 8/2017 | Liu | H01F 27/2876 |
| 2005/0030140 | A1 | 2/2005 | Dahlgren et al. | |
| 2011/0063062 | A1 * | 3/2011 | Lim | H01F 27/322 336/60 |
| 2013/0021127 | A1 * | 1/2013 | Sarver | H01F 27/28 336/60 |
| 2013/0106546 | A1 * | 5/2013 | Outten | H01F 30/12 336/5 |
| 2017/0323714 | A1 | 11/2017 | Lazarus et al. | |

FOREIGN PATENT DOCUMENTS

| | | | | |
|---|---|---|---|---|
| JP | 56137608 A | * | 10/1981 | H01F 27/322 |
| JP | 04369810 A | * | 12/1992 | |

OTHER PUBLICATIONS

U.S. Department of Energy, "Large power transformers and the U.S. electric grid report," dated Jun. 2012, 55 pages, Office of Electricity Delivery and Energy Reliability, Washington, D.C., USA.

J. Kondoh et al., "Fault current limiting transformer with variable reactance," IEEE Transactions on Applied Superconductivity, dated Aug. 24, 2004, pp. 875-878, vol. 14, No. 2, IEEE, New York, USA.

A. M. Pernia et al., "Resonant converter controlled by variable leakage inductance in the transformer (L.I.C.)," Fifth European Conference on Power Electronics and Applications, dated Aug. 6, 2002, pp. 124-129, IET, USA.

H. S. Göktürk et al., "Granular magnetic composites employing cobalt based amorphous alloys in a polymeric host," Journal of Applied Physics, dated May 15, 1993, 4 pages, vol. 73, No. 10, AIP Publishing, Melville, USA.

T. J. Fiske et al., "Relative magnetic permeability of polymeric composites with hybrid particulate fillers," Society of Plastics Engineers Annual Technical Conference and Exhibit 1996 Proceedings, dated May 2, 1996, pp. 1768-1771, CRC Press, London, United Kingdom.

International Search Report for International Application No. PCT/US2019/049016 dated Dec. 4, 2019, 7 pages.

* cited by examiner

LEAKAGE REACTANCE PLATE FOR POWER TRANSFORMER

BACKGROUND

The present disclosure relates generally to power transformers. Electric current flowing through a winding of a power transformer generates main flux and leakage flux. While leakage flux causes a voltage drop across a transformer winding, power transformers are often designed to produce a certain level of leakage flux in order to prevent current spikes during a power failure. In some applications, such as substations where multiple power transformers are coupled in parallel, a power transformer must have a certain leakage flux value. Existing power transformer designs suffer from a number of shortcomings and disadvantages. There remain unmet needs including decoupling the leakage reactance parameter from coil and core design, reducing transformer design time, increasing grid reliability, and reducing transformer construction time. For instance, power transformers are often custom designed for particular applications due to specific power requirements such as voltage ratings, power ratings, and leakage reactance. Significant changes to the coil and core design are often made to satisfy leakage reactance requirements. Custom designs require custom manufacturing, causing a lead time to increase to as much as two years. A shorter lead time would increase the resiliency of the power grid. There is a significant need for the unique apparatuses, methods, systems and techniques disclosed herein.

DISCLOSURE OF ILLUSTRATIVE EMBODIMENTS

For the purposes of clearly, concisely and exactly describing non-limiting exemplary embodiments of the disclosure, the manner and process of making and using the same, and to enable the practice, making and use of the same, reference will now be made to certain exemplary embodiments, including those illustrated in the figures, and specific language will be used to describe the same. It shall nevertheless be understood that no limitation of the scope of the present disclosure is thereby created, and that the present disclosure includes and protects such alterations, modifications, and further applications of the exemplary embodiments as would occur to one skilled in the art with the benefit of the present disclosure.

SUMMARY

Exemplary embodiments include unique systems, methods, techniques and apparatuses for power transformers. Further embodiments, forms, objects, features, advantages, aspects and benefits of the disclosure shall become apparent from the following description and drawings.

DETAILED DESCRIPTION OF ILLUSTRATIVE EMBODIMENTS

Figure 1:
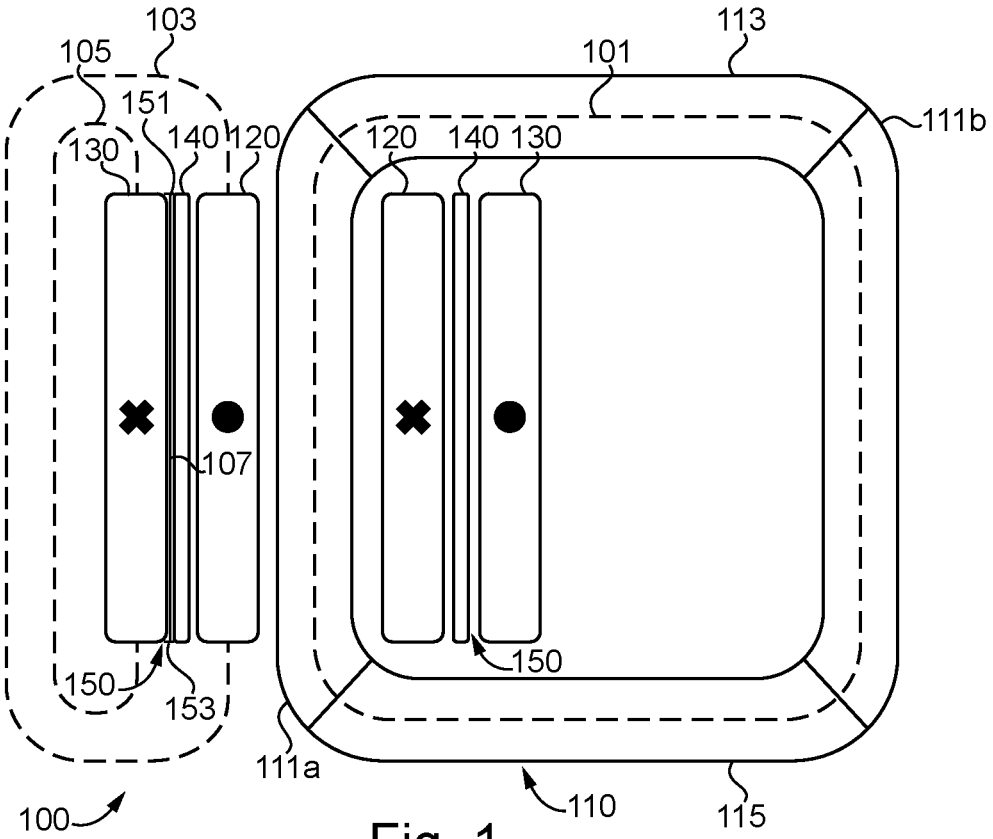
FIG. 1 is a vertical cross section illustrating an exemplary power transformer.

With reference to FIG. 1, there is illustrated a vertical cross section of an exemplary power transformer 100. It shall be appreciated that power transformer 100 may be implemented in a variety of applications, including utility grids having power transmission networks or power distribution networks, and electrical machine drives, to name but a few examples. In certain embodiments, power transformer 100 is incorporated into a utility grid or other power distribution system and is structured to receive AC power having a frequency between 45 Hz and 65 Hz. Although power transformer 100 is illustrated as a single-phase transformer, an exemplary power transformer may be structured as a multiphase power transformer, such as a three-phase power transformer.

In the illustrated embodiment, power transformer 100 includes a core 110 having an upper yoke 113, a lower yoke 115, and a plurality of limbs 111*a*, 111*b*. In other embodiments, core 110 includes additional limbs coupled between upper yoke 113 and lower yoke 115. Core 110 is comprised of ferromagnetic materials, such as iron or electrical steel. In certain embodiments, core 110 may be constructed using a stack of laminations.

Power transformer 100 includes a low voltage winding 120, also known as a coil, wound, or wrapped, around limb 111*a*. Transformer 100 also includes a high voltage winding 130 wound around core 110 and coaxially wound around winding 120. Each winding has a winding height 107 of 800 mm and is separated from winding 120 by an air gap 150. Power transformer 100 is structured to receive AC power at winding 120, step up the voltage of the received power, and output AC power from winding 130 with the stepped up voltage. Power transformer 100 is also structured to receive AC power at winding 130, step down the voltage of the received AC power, and output AC power from winding 120 with a stepped down voltage. Power transformer 100 is structured such that the voltages across low voltage winding 120 and high voltage winding 130 are both within a range between 100 V and 1200 kV.

It shall be appreciated that the configuration of the core and windings of power transformer 100 are illustrated for the purposes of explanation. An exemplary power transformer may include a core of a different configuration or different number of low voltage windings or high voltage windings. For example, some embodiments may include a second low voltage windings wound around high voltage winding 130.

When power flows through winding 120 and winding 130, power transformer 100 is structured to generate a main flux 101 through core 110 and leakage fluxes 103, 105 through the air surrounding windings 120 and 130. Main flux 101 links winding 120 with 130 while leakage flux 103 only links winding 120 and leakage flux 105 only links winding 130. Since windings 120 and 130 are tightly coupled, the magnitude of main flux 101 is greater than the magnitude of leakage fluxes 103 and 105. The inductance associated with leakage fluxes 103 and 105 is known as leakage inductance, or leakage reactance.

Leakage reactance is a key consideration when designing transformers. For example, power transformers coupled in parallel must have matching leakage reactance parameters to limit current circulating between the power transformers. Leakage reactance limits a current spike caused by a fault condition in a power network, protecting the power transformer and other power network components from damage or destruction. The design of the coils and cores of a power transformer affects the leakage reactance of the transformer. Since leakage reactance requirements are often unique for each application, coils and cores must often be customized and redesigned for one application.

Power transformer 100 includes a leakage reactance plate 140 structured to increase the leakage reactance of power transformer 100 without modifying the design of the coils or core. By satisfying the leakage reactance requirements without redesigning the coils and core, power transformer 100 may be used in a wide range of applications by only modifying dimensions of plate 140. Plate 140 is structured so as to not require auxiliary windings, power electronics or other controllers in order to regulate leakage reactance of power transformer 100. Plate 140 is also structured to not affect the mutual inductance between windings 120 and 130 by more than 0.5%, where the relative permeability of the plate is greater than 1 and less than 75. In certain embodiments, the relative permeability of plate 140 is in a range of values greater than 1 and less than 25. A leakage reactance plate having a permeability greater than 75 would require undesirable plate dimensions, such as a brittle plate with a thickness too small to withstand manufacturing stresses. In certain embodiments, plate 140 is structured so as to include a resistivity greater than $0.1\times10^6$ ohm-Cm, such as a plate including nickel ferrites.

Plate 140 is located within air gap 150 between winding 120 and winding 130, the air gap having a first end 151 and a second end 153. In the illustrated embodiment, plate 140 extends the entire winding height 107 and entirely surrounds winding 120. In other embodiments, transformer 100 includes one or more plates within air gap 150 arranged between the first end 151 and second end 153. For example, transformer 100 may include a first plate located proximate to first end 151 and a second plate proximate to second end 153. Such an embodiment may be used where limiting short circuit current is the primary objective, as the leakage field has a lower magnitude at the ends of the windings, reducing the susceptibility to saturation.

Plate 140 is comprised of a polymeric composite, such as an elastomer, with a ferromagnetic filler. For example, the elastomer may include ferromagnetic powder, flakes, filaments, or coated fibers. The ferromagnetic filler may be comprised of nickel, iron, or a ferromagnetic alloy such as Metglass, nickel-iron, or nickel-zinc, to name but a few examples. The volume fraction of the ferromagnetic filler in the elastomer is in a range of 0.2 to 0.7. For example, the ferromagnetic filler may be iron powder having a volume fraction of 0.5 or a nickel-iron powder having a volume fraction of 0.4.

The composition of plate 140 is structured to produce a relative permeability greater than 1 and less than 25. Changing the dimensions and permeability of plate 140 allows the transformer leakage reactance to be varied over a range with no need to modify the design of the core and coils and no need to operate power electronics to control leakage reactance. The use of the composition described above allows the dimensions of the plate 140 to be such that plate 140 can be located within the air gap between windings 120 and 130. It shall be appreciated that any or all of the foregoing features of power transformer 100 may also be present in the other power transformers disclosed herein.

Figure 2:
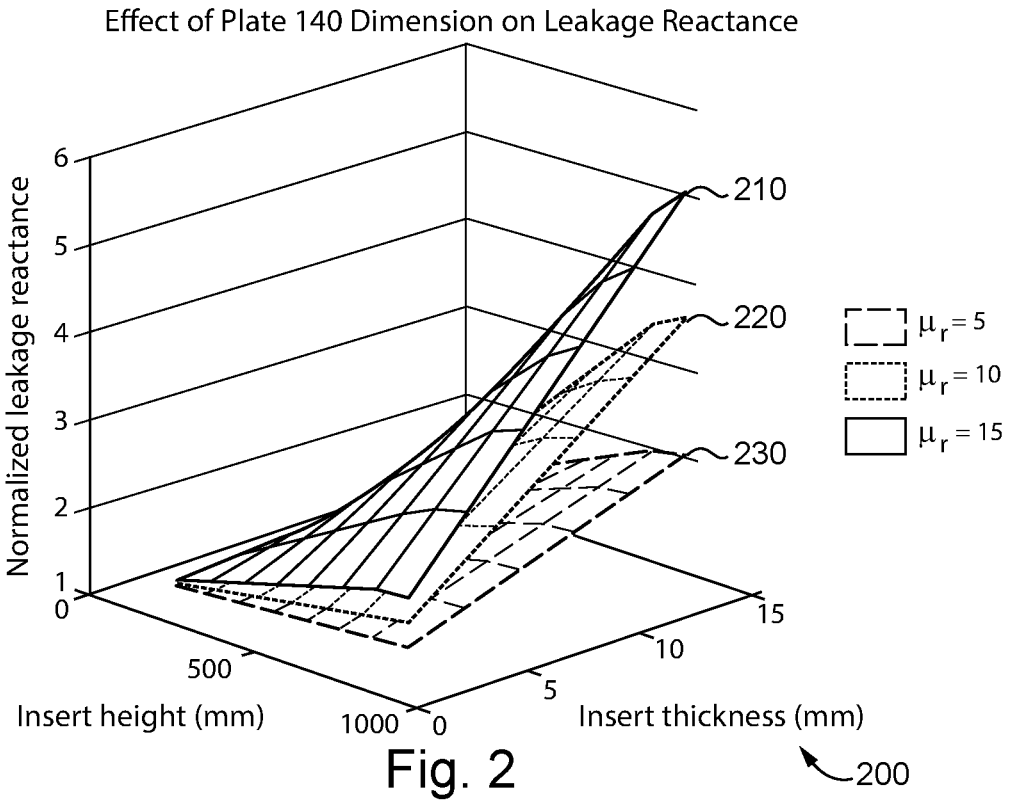
FIG. 2 is a graph illustrating the relationship between plate dimensions and leakage inductance of the exemplary power transformer in FIG. 1.

With reference to FIG. 2 there is a graph 200 illustrating leakage reactance in exemplary power transformer 100. Graph 200 includes a plurality of surfaces 210, 220, and 230 representing leakage reactance for exemplary leakage reactance plates over a range of dimensions including a plate thickness between 2.5 mm to 15 mm and plate height between 100-800 mm. Each surface represents one embodiment of plate 140 with a different relative permeability. Surface 210 represents leakage reactance of plate 140 with a permeability of 5. Surface 220 represents leakage reactance of plate 140 with a relative permeability of 10. Surface 230 represents leakage reactance of plate 140 with a permeability of 15. The illustrated leakage reactance values are normalized against a base case of a plate 140 with a relative permeability of 1.

According to these results, plate 140 with a relative permeability of 5 allows the same coil and core design to have a leakage reactance in a range of 1-2 times the original leakage reactance of the coil and core design without plate 140. If the relative permeability of plate 140 is increased to 15, leakage reactance can be selected over a range of 1-5 times the original leakage reactance. For example, if power transformer 100 has a coil and core design with an original leakage reactance of 4.0%, plate 140 with a relative permeability of 15 would allow transformer 100 to be designed with a leakage reactance between 4.0% and 20.0%.

Figure 3:
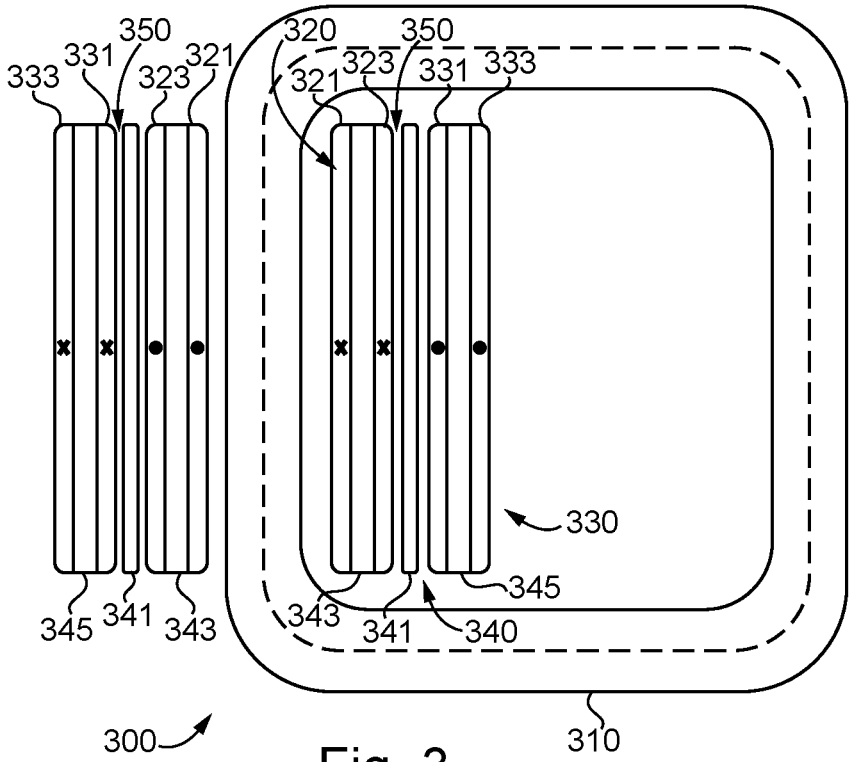
FIG. 3 is a vertical cross section illustrating another exemplary power transformer.

With reference to FIG. 3 there is illustrated an exemplary power transformer 300 including a core 310, a low voltage winding 320, a high voltage winding 330, and a leakage reactance system 340. Leakage reactance system 340 includes a plate 341 located within the air gap 350 between windings 320 and 330, a plate 343 located within winding 320, and a plate 345 located within winding 330. It shall be appreciated that plates 341, 343, and 345 have features analogous to the features of plate 140 in FIG. 1.

Low voltage winding 320 includes a winding portion 321 wound around core 310 and a winding portion 323 wound coaxially around plate 343 and winding portion 321. High voltage winding 330 includes a winding portion 331 wound coaxially around plate 341 and low voltage winding 320, and a winding portion 333 wound around plate 345. In the illustrated embodiment, the plates of leakage reactance system 340 have uniform heights and thicknesses. In other embodiments, each of the plates may have a different height, thickness, or relative permeability. It shall be appreciated that any or all of the foregoing features of transformer 300 may also be present in the other power transformers disclosed herein.

Figure 4:
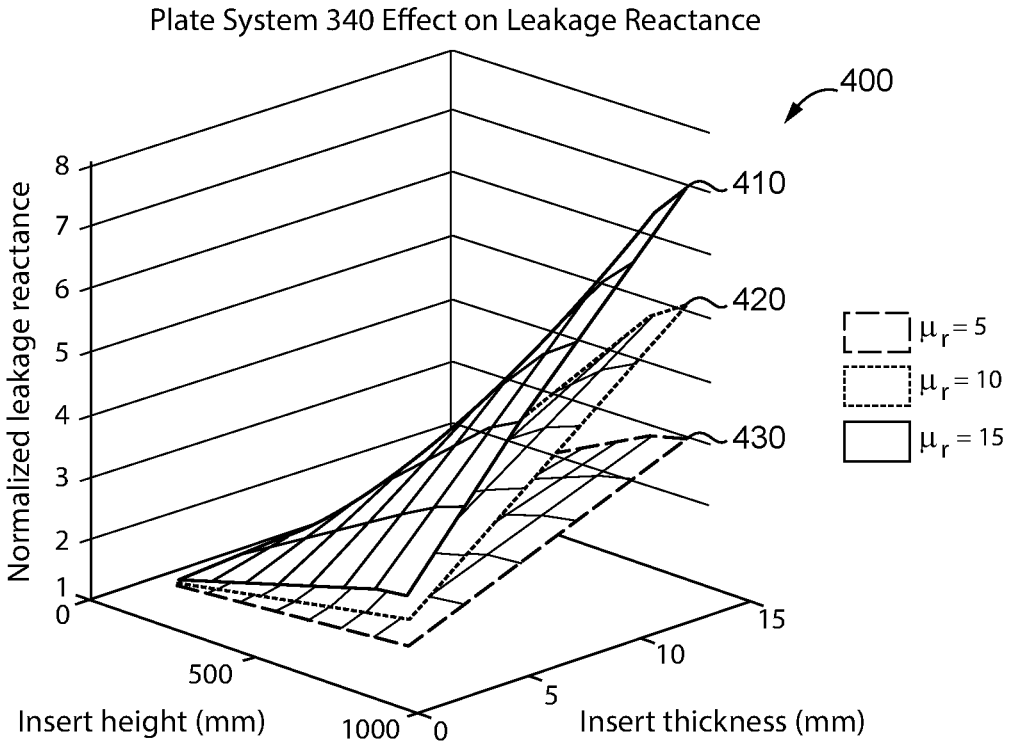
FIG. 4 is a graph illustrating the relationship between plate dimensions and leakage inductance of the exemplary power transformer in FIG. 3.

With reference to FIG. 4 there is a graph 400 illustrating leakage reactance in exemplary power transformer 300. Graph 400 includes a plurality of surfaces 410, 420, and 430 representing leakage reactance for exemplary leakage reactance systems 340 over a range of dimensions including uniform plate thickness between 2.5 mm to 15 mm and uniform plate heights between 100-800 mm. Each surface represents one embodiment of plate 140 with a different relative permeability. Surface 410 represents leakage reactance of plate 140 with a permeability of 5. Surface 420 represents leakage reactance of plate 140 with a relative permeability of 10. Surface 430 represents leakage reactance of plate 140 with a permeability of 15. The illustrated leakage reactance values are normalized against a base case of a plate 140 with a relative permeability of 1.

According to these results, leakage reactance system 340 can be used in an exemplary transformer for a wider range of leakage reactances compared to plate 140 in FIG. 1. System 340 with a relative permeability of 5 allows the same coil and core design to have a leakage reactance in a range of 1-3 times the original leakage reactance of the coil and core design without plate 140. If the relative permeability of the plates in system 340 is increased to 15, leakage reactance can be selected over a range of 1-7 times the original leakage reactance.

Figure 5:
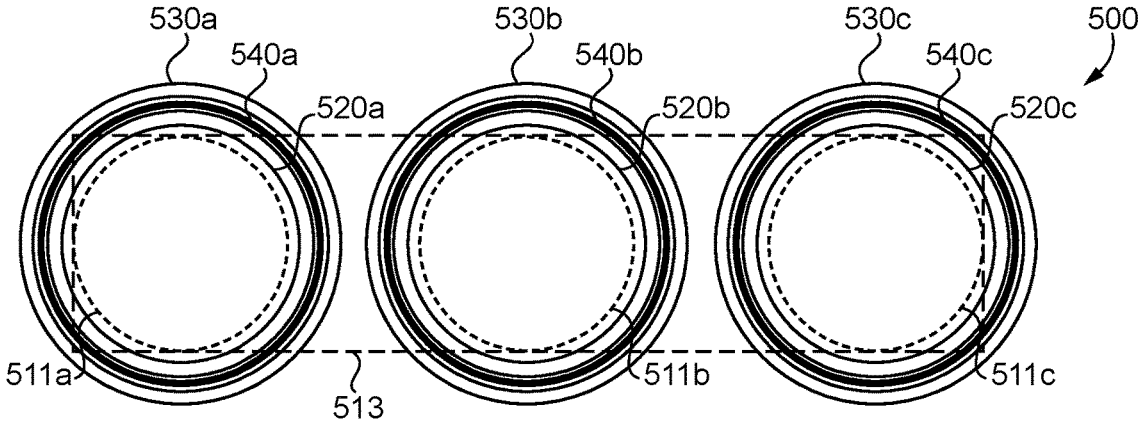
FIGS. 5-7 are horizontal cross sections illustrating exemplary three-phase power transformers.

With reference to FIG. 5 there is illustrated a horizontal cross section of an exemplary three-phase power transformer 500 including a core having an upper yoke 513 coupled to limbs 511*a-c*. A first low voltage winding 520*a* is wound around core limb 511*a*. A first high voltage winding 530*a* is wound around winding 520*a*, separated by an air gap. A second low voltage winding 520*b* is wound around core limb 511*b*. A second high voltage winding 530*b* is wound around winding 520*b*, separated by an air gap. A third low voltage winding 520*c* is wound around core limb 511*c*. A third high voltage winding 530*c* is wound around winding 520*c*, separated by an air gap.

Transformer 500 includes three leakage reactance plates 540*a-c* each located in the air gap between one low voltage winding and one high voltage winding. Each plate is structured as a hollow tube fully surrounding the low voltage winding.

Figure 6:
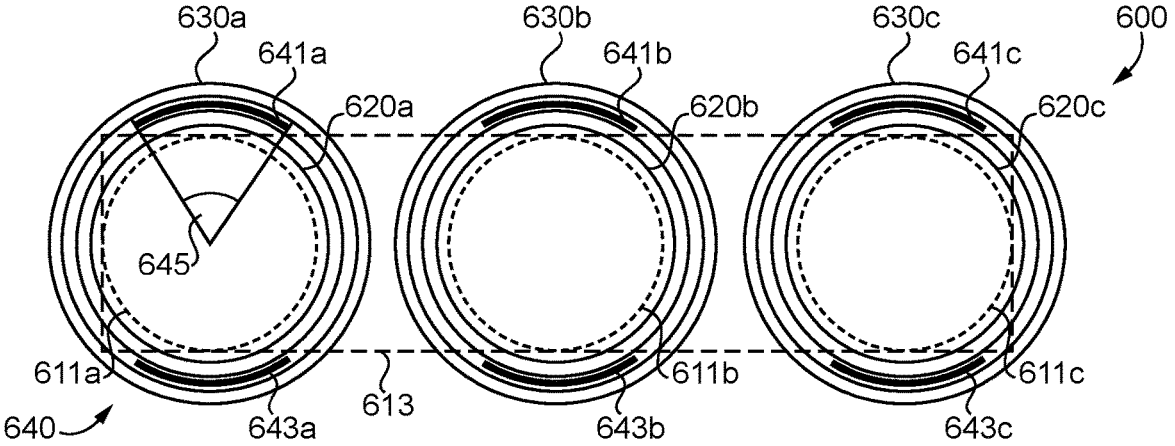

With reference to FIG. 6 there is illustrated a horizontal cross section of an exemplary three-phase power transformer 600 including a core having an upper yoke 613 coupled to limbs 611*a-c*. A first low voltage winding 620*a* is wound around core limb 611*a*. A first high voltage winding 630*a* is wound around winding 620*a*, separated by an air gap. A second low voltage winding 620*b* is wound around core limb 611*b*. A second high voltage winding 630*b* is wound around winding 620*b*, separated by an air gap. A third low voltage winding 620*c* is wound around core limb 611*c*. A third high voltage winding 630*c* is wound around winding 620*c*, separated by an air gap.

Transformer 600 includes a leakage reactance system 640 including a plurality of plates between each low voltage winding and high voltage winding, each plate having an arc length 645. Plates 641*a* and 643*a* are located between winding 620*a* and 630*a* in a portion of the air gap where the footprint of upper yoke 613 does not overlap either plate. Plates 641*b* and 643*b* are located between winding 620*b* and 630*b* in a portion of the air gap where the footprint of upper yoke 613 does not overlap either plate. Plates 641*c* and 643*c* are located between winding 620*c* and 630*c* in a portion of the air gap where the footprint of upper yoke 613 does not overlap either plate. By placing each plate of system 640 outside the footprint of upper yoke 613, system 640 is structured to reduce the necessary size of the core while causing an increase in the leakage reactance equal to the increase of leakage reactance caused by the continuous plate of FIG. 5.

Figure 7:
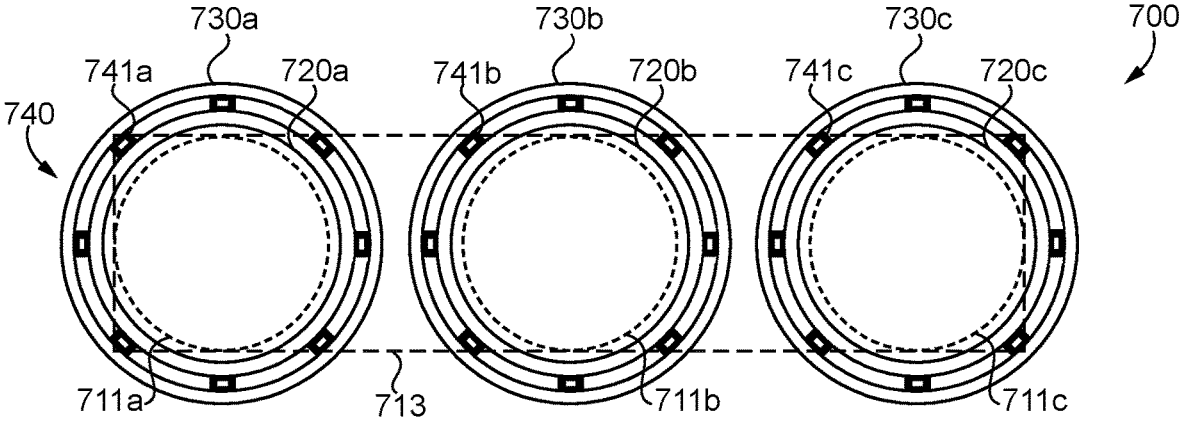

With reference to FIG. 7 there is illustrated a horizontal cross section of an exemplary three-phase power transformer 700 including a core having an upper yoke 713 coupled to limbs 711*a-c*. A first low voltage winding 720*a* is wound around core limb 711*a*. A first high voltage winding 730*a* is wound around winding 720*a*, separated by an air gap. A second low voltage winding 720*b* is wound around core limb 711*b*. A second high voltage winding 730*b* is wound around winding 720*b*, separated by an air gap. A third low voltage winding 720*c* is wound around core limb 711*c*. A third high voltage winding 730*c* is wound around winding 720*c*, separated by an air gap.

Transformer 700 includes a leakage reactance system 740 including a plurality of plates formed into a plurality of spacers, such as spacers 741*a-c*. Each spacer is located between the low voltage winding and high voltage winding of one phase of transformer 700.

Figure 8:
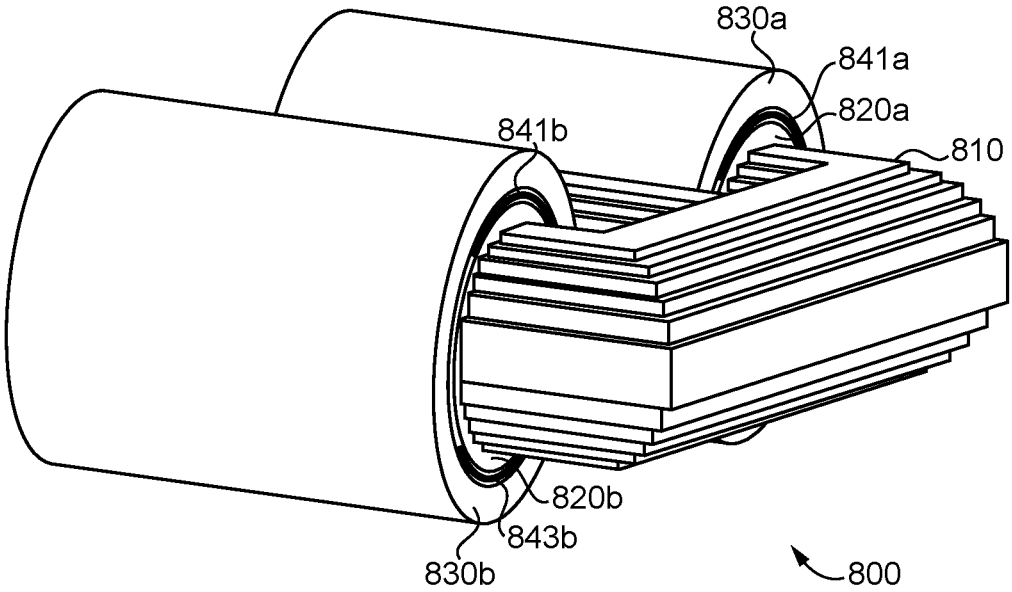
FIG. 8 illustrates an exemplary two-phase power transformer.

With reference to FIG. 8 there is illustrated an exemplary two-phase transformer 800 including a core 810. The first phase of the transformer includes a low voltage winding 820*a* wound around core 810 and a high voltage winding 830*a* wound coaxially around low voltage winding 820*a*, separated by an air gap. Located within the portions of the air gap outside of the footprint of core 810 relative to a horizontal cross section of transformer 800 is a leakage reactance system including plate 841*a*.

The second phase of the transformer includes a low voltage winding 820*b* wound around core 810 and a high voltage winding 830*b* wound coaxially around low voltage winding 820*a*, separated by an air gap. Located within the portions of the air gap outside of the footprint of core 810 relative to a horizontal cross section of transformer 800 is a leakage reactance system including plates 841*b* and 843*b*.

Further written description of a number of exemplary embodiments shall now be provided. One embodiment is a transformer comprising a core; a first winding wound around the core; a second winding coaxially wound around the first winding so as to surround the first winding and forming an air gap between the first winding and the second winding; and a plate having a relative permeability greater than 1 and less than 75 and inserted into the air gap.

In certain forms of the foregoing transformer, the plate includes an elastomer including a volume ratio of a ferromagnetic element between 0.2 and 0.7. In certain forms, the ferromagnetic element includes nickel powder, nickel flakes, or nickel filament. In certain forms, the ferromagnetic element includes iron powder, iron flakes, or iron filament. In certain forms, the plate is structured as a hollow tube surrounding the first winding. In certain forms, the transformer includes a plurality of radial supports located within the air gap, wherein the plate comprises one of the radial supports. In certain forms, the core includes a first limb and a second limb, wherein the transformer includes a third winding wound around the second limb, a fourth winding coaxially wound around the first winding so as to surround the third winding and forming a second air gap between the third winding and fourth winding; and a second plate having a relative permeability greater than 1 and less than 25 structured to be inserted into the second air gap. In certain forms, the transformer includes a third plate having a relative permeability greater than 1 and less than 25 structured to be inserted into the first air gap and a fourth plate having a relative permeability greater than 1 and less than 25 structured to be inserted into the second air gap, wherein the first plate and the third plate are positioned opposite of each other in the first air gap, and wherein the second plate and the fourth plate are positioned opposite of each other in the second air gap. In certain forms, an arc length of each of the first plate, the second plate, the third plate, and the fourth plate is less than 90 degrees. In certain forms, the transformer comprises a second plate having a relative permeability greater than 1 and less than 25 inserted into the first winding and a third plate having a relative permeability greater than 1 and less than 25 inserted into the second winding.

Another exemplary embodiment is a method for constructing a power transformer comprising wrapping a first winding around a limb of a core; coaxially wrapping a second winding around the first winding such that an air gap is formed between the first winding and the second winding; forming a plurality of interchangeable plates each having a relative permeability greater than 1 and less than 75 and each structured to be placed in the air gap between the first winding and the second winding so as to increase a leakage reactance of the power transformer; selecting one plate of the plurality of interchangeable plates to be inserted into the air gap based on a desired leakage reactance value; and inserting the selected plate into the air gap.

In certain forms of the foregoing method, wrapping the first winding around the limb of the core includes wrapping a first portion of the first winding around the limb, placing a second plate having a relative permeability greater than 1 and less than 25 proximate to the first portion, and wrapping a second portion of the first winding around the second plate and the first portion of the first winding. In certain forms, wrapping the second winding around the first winding and first plate includes wrapping a first portion of the second winding around the first winding and plate, placing a third plate having a relative permeability greater than 1 and less than 25 proximate to the first portion of the second winding, and wrapping a second portion of the second winding around the third plate and the first portion of the second winding. In certain forms, the first plate, second plate, and third plate each include a volume ratio of a ferromagnetic element between 0.2 and 0.7. In certain forms, the ferromagnetic element includes nickel. In certain forms, the plate is formed into a hollow tube and placing the plate includes surrounding a portion of the first winding with the plate. In certain forms, the method comprises placing a second plate having a relative permeability greater than 1 and less than 25 proximate between the first winding and second winding such that the second plate is located in the air gap opposite of the first plate. In certain forms, the first plate and the second plate are each curved plates with an arc length of less than 90 degrees. In certain forms, the method comprises placing a second plate having a relative permeability greater than 1 and less than 25 proximate between the first winding and second winding such that the second plate is located in the air gap; wrapping a third winding around a second limb of the core; coaxially wrapping a fourth winding around the third winding such that a second air gap is formed between the first winding and second winding; placing a third plate having a relative permeability greater than 1 and less than 25 proximate between the third winding and fourth winding such that the second plate is located in the second air gap; and placing a fourth plate having a relative permeability greater than 1 and less than 25 proximate between the third winding and fourth winding such that the second plate is located in the second air gap. In certain forms, the core includes an upper yoke oriented horizontally and perpendicular to both the first limb and the second limb, and wherein the footprint of the upper yoke relative to a horizontal cross section of the first plate and second plate does not overlap the first plate and the second plate.

While the present disclosure has been illustrated and described in detail in the drawings and foregoing description, the same is to be considered as illustrative and not restrictive in character, it being understood that only certain exemplary embodiments have been shown and described, and that all changes and modifications that come within the spirit of the present disclosure are desired to be protected. It should be understood that while the use of words such as "preferable," "preferably," "preferred" or "more preferred" utilized in the description above indicate that the feature so described may be more desirable, it nonetheless may not be necessary, and embodiments lacking the same may be contemplated as within the scope of the present disclosure, the scope being defined by the claims that follow. In reading the claims, it is intended that when words such as "a," "an," "at least one," or "at least one portion" are used there is no intention to limit the claim to only one item unless specifically stated to the contrary in the claim. The term "of" may connote an association with, or a connection to, another item, as well as a belonging to, or a connection with, the other item as informed by the context in which it is used. The terms "coupled to," "coupled with" and the like include indirect connection and coupling, and further include but do not require a direct coupling or connection unless expressly indicated to the contrary. When the language "at least a portion" and/or "a portion" is used, the item can include a portion and/or the entire item unless specifically stated to the contrary.

What is claimed is:

1. A transformer comprising:

a core;

a first winding wound around the core;

a second winding coaxially wound around the first winding so as to surround the first winding and forming an air gap between the first winding and the second winding; and a plate selected from a plurality of interchangeable plates based on a desired leakage reactance value, each of the plurality of interchangeable plates having a relative permeability greater than 1 and less than 75 and each structured to be placed in the air gap between the first winding and the second winding so as to increase a leakage reactance of the transformer, each of a plurality of the plurality of interchangeable plates having a different relative permeability than other interchangeable plates of the plurality of the plurality of interchangeable plates.

2. The transformer of claim 1 wherein the plate includes an elastomer including a volume ratio of a ferromagnetic element between 0.2 and 0.7.

3. The transformer of claim 2 wherein the ferromagnetic element includes nickel powder, nickel flakes, or nickel filament.

4. The transformer of claim 2 wherein the ferromagnetic element includes iron powder, iron flakes, or iron filament.

5. The transformer of claim 1 wherein the plate is structured as a hollow tube surrounding the first winding.

6. The transformer of claim 1 wherein the transformer includes a plurality of radial supports located within the air gap, wherein the plate comprises one of the radial supports.

7. The transformer of claim 1 wherein the core includes a first limb and a second limb, wherein the transformer includes a third winding wound around the second limb, a fourth winding coaxially wound around the third winding so as to surround the third winding and forming a second air gap between the third winding and fourth winding; and a second plate having a relative permeability greater than 1 and less than 25 structured to be inserted into the second air gap.

8. The transformer of claim 7 including a third plate having a relative permeability greater than 1 and less than 25 structured to be inserted into the first air gap and a fourth plate having a relative permeability greater than 1 and less than 25 structured to be inserted into the second air gap, wherein the first plate and the third plate are positioned opposite of each other in the first air gap, and wherein the second plate and the fourth plate are positioned opposite of each other in the second air gap.

9. The transformer of claim 8 wherein an arc length of each of the first plate, the second plate, the third plate, and the fourth plate is less than 90 degrees.

10. The transformer of claim 1 further comprising a second plate having a first relative permeability greater than 1 and less than 25 located within the first winding and a third plate having a second relative permeability greater than 1 and less than 25 located within the second winding, wherein the first relative permeability and the second relative permeability are different permeabilities.

11. A method for constructing a power transformer comprising:

wrapping a first winding around a limb of a core;

coaxially wrapping a second winding around the first winding such that an air gap is formed between the first winding and the second winding;

selecting a plate from a plurality of interchangeable plates to be inserted into the air gap based on a desired leakage reactance value, each of the plurality of interchangeable plates having a relative permeability greater than 1 and less than 75 and each structured to be placed in the air gap between the first winding and the second winding so as to increase a leakage reactance of the power transformer, wherein each of a plurality of the plurality of interchangeable plates have a different relative permeability than other interchangeable plates of the plurality of the plurality of interchangeable plates; and inserting the selected plate into the air gap.

12. The method of claim 11 wherein wrapping the first winding around the limb of the core includes wrapping a first portion of the first winding around the limb, placing a second plate having a relative permeability greater than 1 and less than 25 proximate to the first portion, and wrapping a second portion of the first winding around the second plate and the first portion of the first winding.

13. The method of claim 12 wherein wrapping the second winding around the first winding and first plate includes wrapping a first portion of the second winding around the first winding and plate, placing a third plate having a relative permeability greater than 1 and less than 25 proximate to the first portion of the second winding, and wrapping a second portion of the second winding around the third plate and the first portion of the second winding.

14. The method of claim 13 wherein the first plate, second plate, and third plate each include a volume ratio of a ferromagnetic element between 0.2 and 0.7.

15. The method of claim 13 wherein the ferromagnetic element includes nickel.

16. The method of claim 11 wherein the plate is formed into a hollow tube and placing the plate includes surrounding a portion of the first winding with the plate.

17. The method of claim 11 comprising placing a second plate having a relative permeability greater than 1 and less than 25 proximate between the first winding and second winding such that the second plate is located in the air gap opposite of the first plate.

18. The method of claim 17 wherein the first plate and the second plate are each curved plates with an arc length of less than 90 degrees.

19. The method of claim 11 comprising:

placing a second plate having a first relative permeability greater than 1 and less than 25 proximate between the first winding and second winding such that the second plate is located in the air gap;

wrapping a third winding around a second limb of the core;

coaxially wrapping a fourth winding around the third winding such that a second air gap is formed between the first winding and second winding;

placing a third plate having a second relative permeability greater than 1 and less than 25 proximate between the third winding and fourth winding such that the second plate is located in the second air gap; and placing a fourth plate having a third relative permeability greater than 1 and less than 25 proximate between the third winding and fourth winding such that the second plate is located in the second air gap, wherein a plurality of the first relative permeability, the second relative permeability, and the third relative permeability are different permeabilities.

20. The method of claim 19 wherein the core includes an upper yoke oriented horizontally and perpendicular to both the first limb and the second limb, and wherein the footprint of the upper yoke relative to a horizontal cross section of the first plate and second plate does not overlap the first plate and the second plate.

* * * * *